US006682252B2

(12) United States Patent
Battey et al.

(10) Patent No.: US 6,682,252 B2
(45) Date of Patent: Jan. 27, 2004

(54) TORSIONAL ENERGY JOINT FOR SEATING UNIT

(75) Inventors: Robert J. Battey, Kentwood, MI (US); Gary L. Karsten, Wayland, MI (US)

(73) Assignee: Steelcase Development Corporation, Caledonia, MI (US)

( * ) Notice: Subject to any disclaimer, the term of this patent is extended or adjusted under 35 U.S.C. 154(b) by 11 days.

(21) Appl. No.: 10/087,490

(22) Filed: Mar. 1, 2002

(65) Prior Publication Data

US 2003/0164635 A1 Sep. 4, 2003

(51) Int. Cl.[7] ..... A47C 1/024

(52) U.S. Cl. ..... 403/84; 297/374; 403/146; 403/101

(58) Field of Search ..... 403/83, 98, 146, 403/99, 84, 97, 101, 96, 322.1; 297/374

(56) References Cited

U.S. PATENT DOCUMENTS 4,529,247 A 7/1985 Stumpf et al.
4,597,567 A 7/1986 Racca
5,486,056 A * 1/1996 Thorn ..... 403/322.4
5,566,048 A * 10/1996 Esterberg et al. ..... 361/681
D388,629 S 1/1998 Piretti
D393,955 S 5/1998 Piretti
D411,772 S 7/1999 Piretti

* cited by examiner

*Primary Examiner*—John R. Cottingham
(74) *Attorney, Agent, or Firm*—Price Heneveld Cooper DeWitt & Litton LLP

(57) ABSTRACT

A joint is provided that automatically pre-tensions itself during assembly. The joint includes first and second structural members, such as a back upright and a pivot link in a chair. A torsion spring bushing and a pair of threaded anchors pivotally connect the first structural member to the second structural member. The anchor and back upright include mating angled surfaces that inter-engage and rotate the torsion spring bushing during assembly in a manner that pre-tensions the spring bushing while engaging the anchors in a direction parallel an axis of rotation defined by the joint.

21 Claims, 6 Drawing Sheets

TORSIONAL ENERGY JOINT FOR SEATING UNIT

BACKGROUND

The present invention relates to energy joints biased with a torsion spring, such as are sometimes used for biasing the back of an office chair to an upright position. However, the present invention is not believed to be limited to office chairs, nor to furniture. Instead, it is contemplated that the present torsional energy joint is useful in many different applications, particularly high-volume assembly situations, where it is desirable to provide a torsional joint with pre-tension.

Chairs often have reclineable backs for increased comfort. The reclineable backs are typically biased toward an upright position in a manner that both supports a person's upper torso when leaning rearwardly, yet that also permits a comfortable recline that feels secure during the reclining motion. Many different types and styles of biasing mechanisms are known in the art. However, improvements are desired to overcome various problems. For example, many such biasing mechanisms include undesirably expensive components and/or "too many" components. Further, the size of the components and/or the complexity of the assembly can lead to warranty problems and/or unacceptably increase the cost of repair (i.e. "in factory" repairs as well as "in service" repairs in the field).

Another desired improvement is in the area of assembly. Many assemblies require multiple and complex fixtures for holding components together during assembly. The fixturing is often made considerably more complex where the biasing mechanism must be given a pre-tension and then held together until the assembly is sufficient to hold the biasing mechanism in its pre-tensioned state. It is noted that pre-tension is required, for example, to provide an initial level of support to a seated user's upper torso before recline begins. The pre-tension forces can be considerable, particularly where the chair is adjustable for large or heavy persons, and where the torque arm on the biasing spring is small compared to the torque of the back upright that a seated user leans against. This results in a fixture that must be capable of applying considerable forces, yet that must do so safely and quickly.

In office chairs and public seating, the above problems are sometimes exacerbated by the appearance requirements of these products, because the products must provide optimal aesthetics in order to result in a sale. In modern times, many product designs have tended to include sleek and thin profiles, and hidden or minimally-sized functional components. This complicates and makes more difficult the design of long-lasting durable biasing mechanisms that are replaceable and repairable.

Accordingly, an apparatus is desired solving the aforementioned problems and having the aforementioned advantages.

SUMMARY OF THE PRESENT INVENTION

In one aspect of the present invention, a jointed apparatus includes first and second structural members, a torsion spring adapted to pivotally support and rotationally bias the first structural member relative to the second structural member about a joint, an anchor for holding the first and second structural members together, and a pre-tensioning device that torsionally tensions the torsion spring as the first and second structural members, the torsion spring, and the anchor member are assembled together.

In another aspect of the present invention, a seating unit includes first and second elongated structural members pivoted together and defining a joint. A bushing is provided that includes a first section attached to the first structural member, a second section, and a torsion spring connecting the first and second sections. A pre-tensioning device engages the second section and the second structural member. The pre-tensioning device has angled surfaces that inter-engage to rotate the second section during assembly to pre-tension the torsion spring during assembly.

In another aspect of the present invention, a method comprises steps of attaching first and second structural members and a torsion spring together with an anchor to form a joint. The step includes torsionally pre-tensioning the torsion spring simultaneously and increasingly as the anchor is tightened in a direction parallel an axis of rotation defined by the joint and the joint is assembled together.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
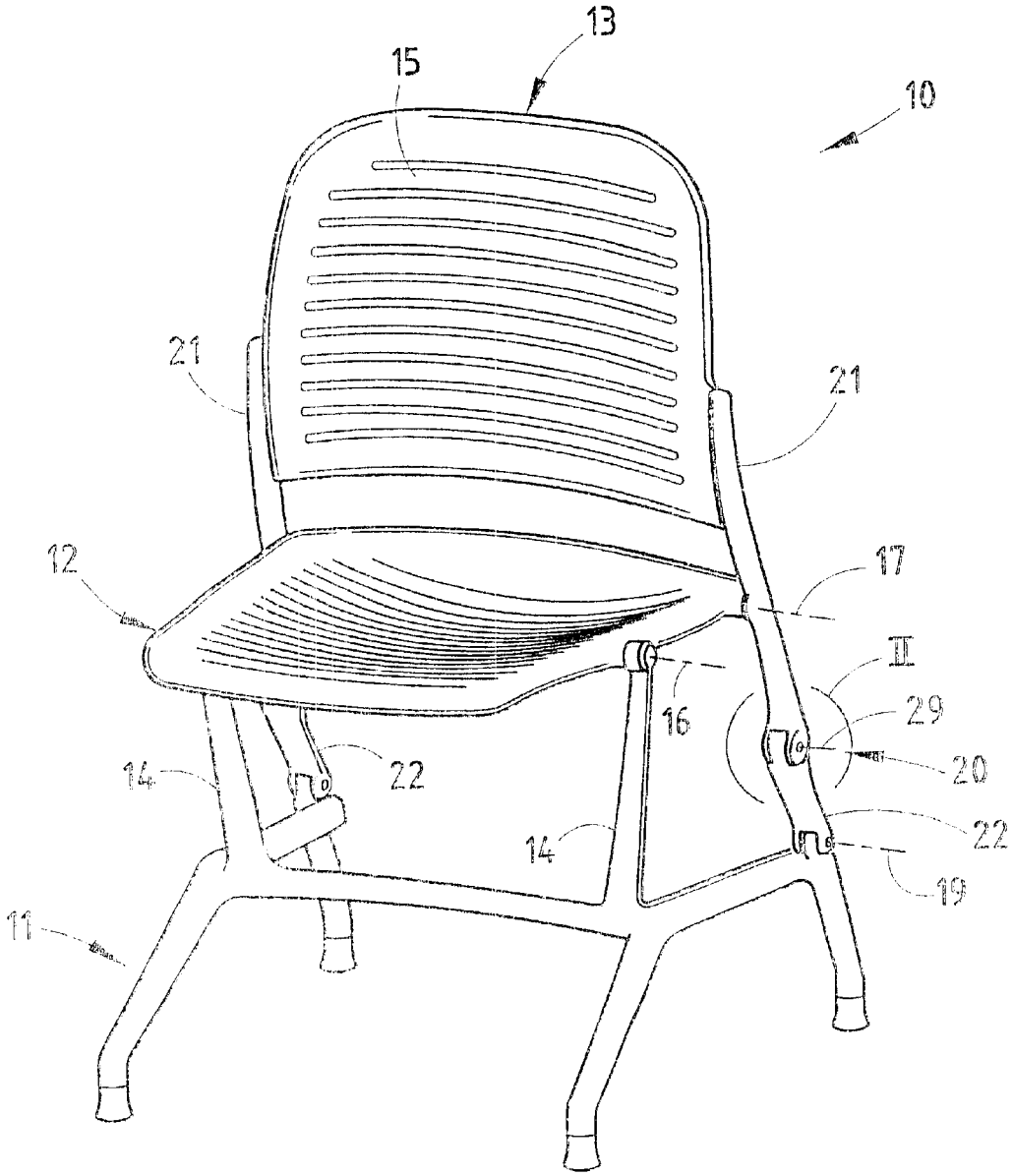
FIG. 1 is a perspective view of a chair including a joint embodying the present invention.
Figure 2:
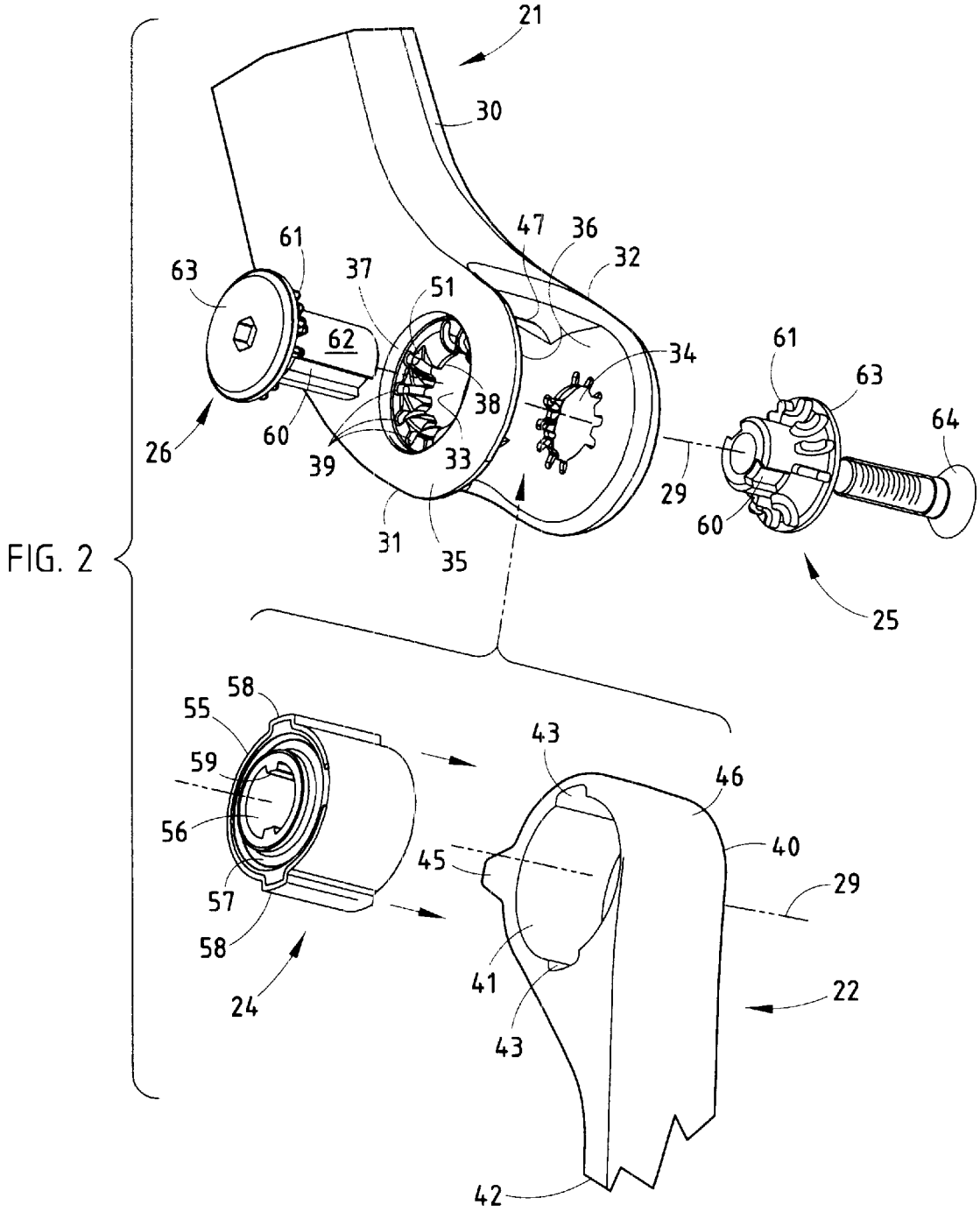
FIG. 2 is an exploded perspective view of the joint circled as area II in FIG. 1.
Figure 3:
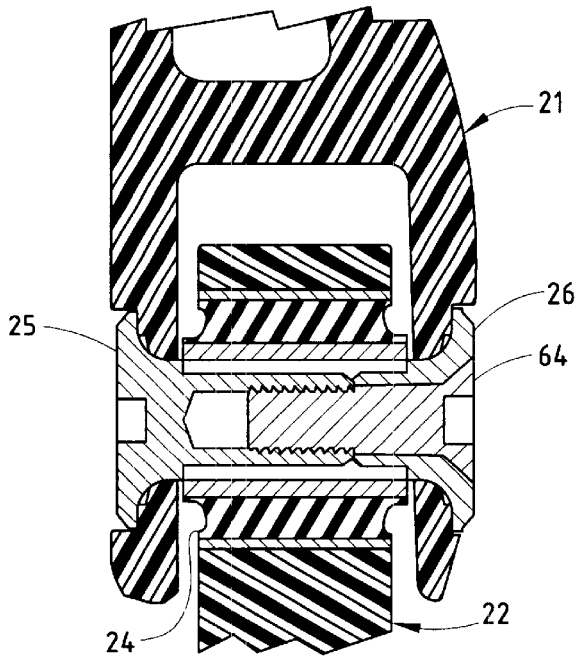
FIG. 3 is a cross sectional view of the joint circled in FIG. 1, the cross section being taken parallel an axis of rotation of the joint.
Figure 4:
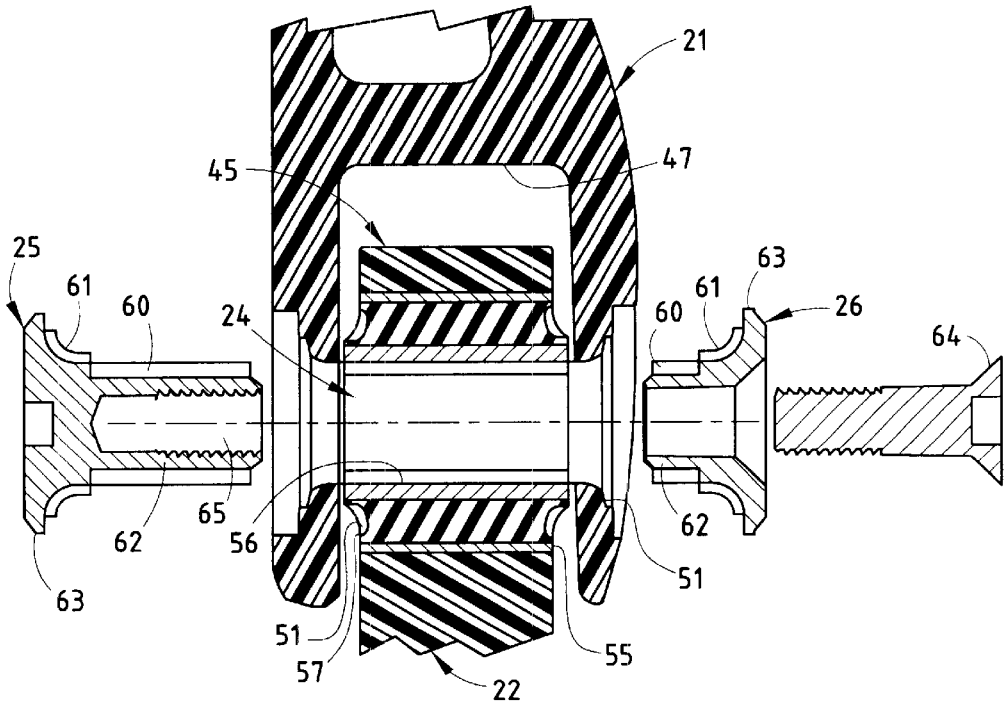
FIG. 4 is an exploded view of FIG. 3.
Figure 5:
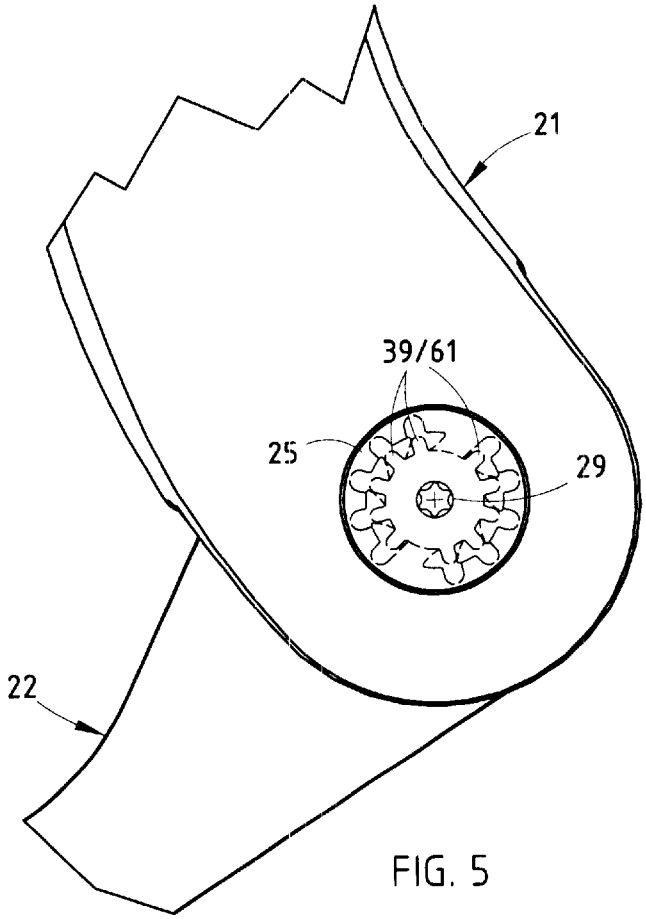
FIG. 5 is a side view of the joint circled in FIG. 1.

A joint 20 (FIG. 1) is provided that automatically pre-tensions itself during assembly. The joint 20 includes first and second structural members 21 and 22, such as the illustrated back upright (21) and the pivot link (22) in the chair 10. A torsion spring bushing 24 (FIG. 2) and a pair of mating anchors 25 and 26 pivotally connect the first structural member 21 to the second structural member 22, as described below. In the illustrated arrangement, the anchors 25 and 26 and back upright 21 include mating surfaces that inter-engage and rotate the torsion spring bushing 24 during assembly in a manner that pre-tensions the torsion spring bushing 24 while the anchors 25 and 26 are drawn together in a direction parallel an axis of rotation 29 defined by the joint 20. The spring bushing 24 further supports the upright 21 with increasing torque during recline of the upright 21, which provides a comfortable counterbalancing support to a seated user during recline.

Chair 10 (FIG. 1) includes a four-legged base frame 11, a seat 12, a back assembly 13, and two links 22. The four-legged frame 11 includes a pair of seat-supporting standards 14 located generally at a mid-point of the seat and on opposing sides of the seat 12. Back assembly 12 includes a torso-supporting panel 15, and a pair of uprights 21 secured to opposing sides and hanging downwardly. The seat 12 is pivoted to a top of the standards 14 at a middle-of-seat pivot axis 16, and is pivoted to the back uprights 21 at rear-of-seat pivot axis 17. Each link 22 is pivoted to the associated back upright 21 at upper link pivot axis 29 and is pivoted to the base frame 11 at lower link pivot axis 19. By this arrangement, a four bar linkage is constructed that supports the seat and back for synchronous movement upon recline of the back by a seated user. Due to the vertical orientation of the links 22 in their "at rest" position and due to the middle-location of the middle-of-seat pivot axis (which is close to a center of gravity for a seated user), the torsion spring bushings 24 do not need to be excessively strong nor large in order to provide sufficient torque for a comfortable recline by a seated user.

It is contemplated that, even though a particular joint 20 illustrated, any of the joints of the four-bar linkage in the chair 10 could be similarly constructed, using the present inventive principles. Further, it is contemplated that the present joint arrangement can be used on any seating unit where a pre-tensioned torsional spring arrangement is desired, such as pedestal chairs, or stadium or auditorium seating, or in any chair or bench seating where a bias is desired, any transportation seating (e.g. buses, airplanes, boats, and other vehicles), and the like. Also, it is contemplated that the present joint arrangement can be used in a wide variety of non-seating applications, such as for control levers, handles, and the like where it is desirable to bias a member to a home position with pre-tension, e.g. to prevent accidental movement.

As noted above, in the illustrated arrangement, the first and second structural members comprise the back upright 21 and the pivot link 22 in the chair 10. The chair 10 is sufficiently described above (and below) for an understanding of the present invention, but for the reader's benefit it is noted that a chair like chair 10 is disclosed in more detail in application Ser. No. 09/578,568, file May 25, 2000, entitled Synchrotilt Chair, the entire contents of which are incorporated herein by reference. It is specifically noted that a joint 20 can be incorporated into one of the joints in the single-post pedestal base chair disclosed in application '568, such as in the link that is most similar to the four-legged chair shown in the application '568.

Figure 6:
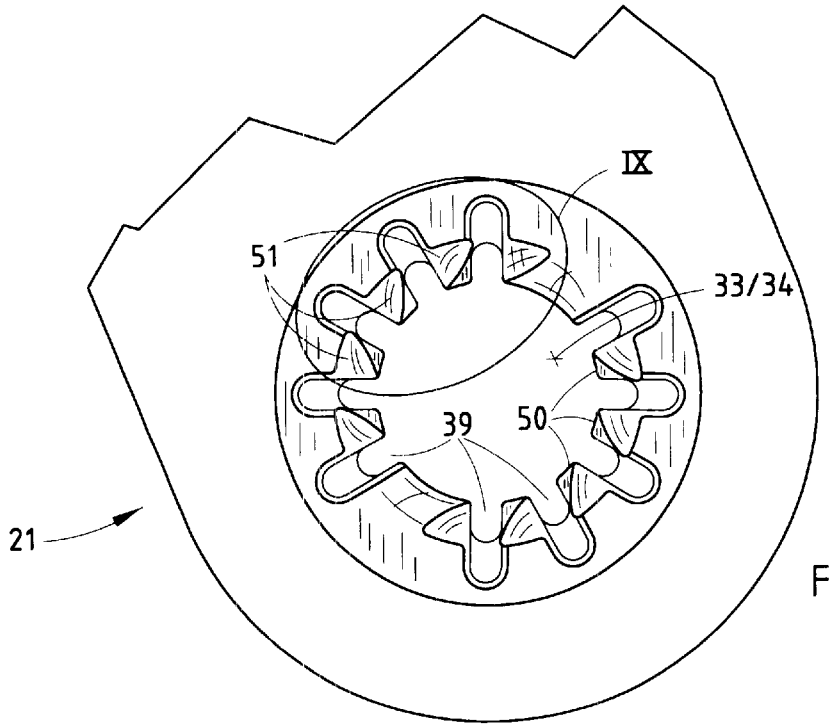
FIG. 6 is an enlarged side view of a bottom section of the back upright shown in FIG. 5, the bottom section forming a part of the joint.

The illustrated back upright 21 (FIG. 2) comprises a hollow polymeric component molded by gas-assist injection-molding techniques. The back upright 21 includes an elongated body 30 with opposing longitudinally-extending parallel flanges 31 and 32 extend from its lower end. The flanges 31 and 32 include aligned holes 33 and 34, and further each include an outer surface 35 and an inner surface 36. The outer surfaces 35 each include a recess 37 for receiving a washer-like head 63 on the outer ends of the anchor members 25 and 26. At a bottom of each of the recesses 37 is an annular flange 38 that defines a plurality of radially-positioned splines or grooves 39 that extend longitudinally through the holes 33 (and 34). There are illustrated ten such grooves 39 (see FIG. 6), but more or less can be used depending upon the functional requirements and stresses generated by the particular spring bushing 24 being used.

Figure 7:
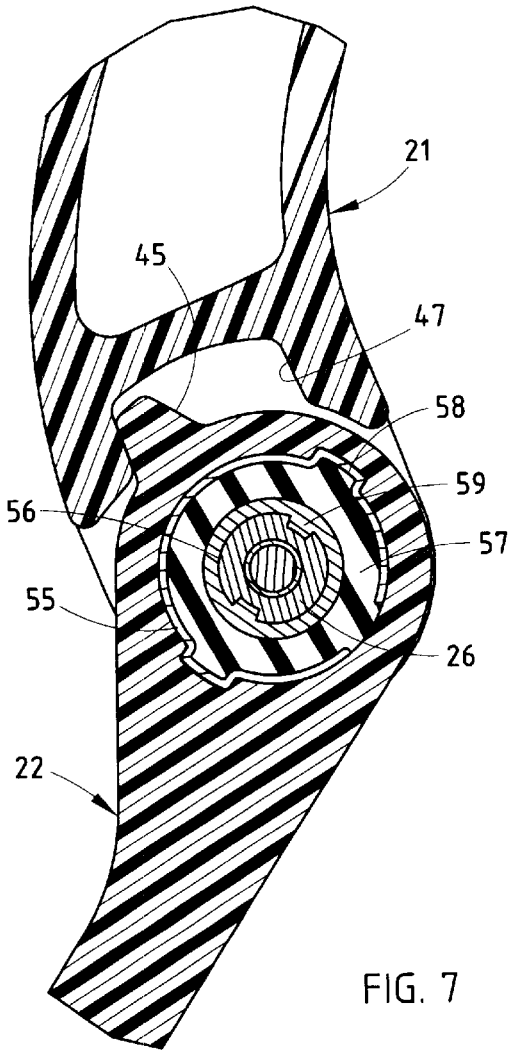
FIG. 7 is a cross sectional view of the joint circled as area II in FIG. 1, the cross section being taken perpendicular to the axis of rotation of the joint.
Figure 8:
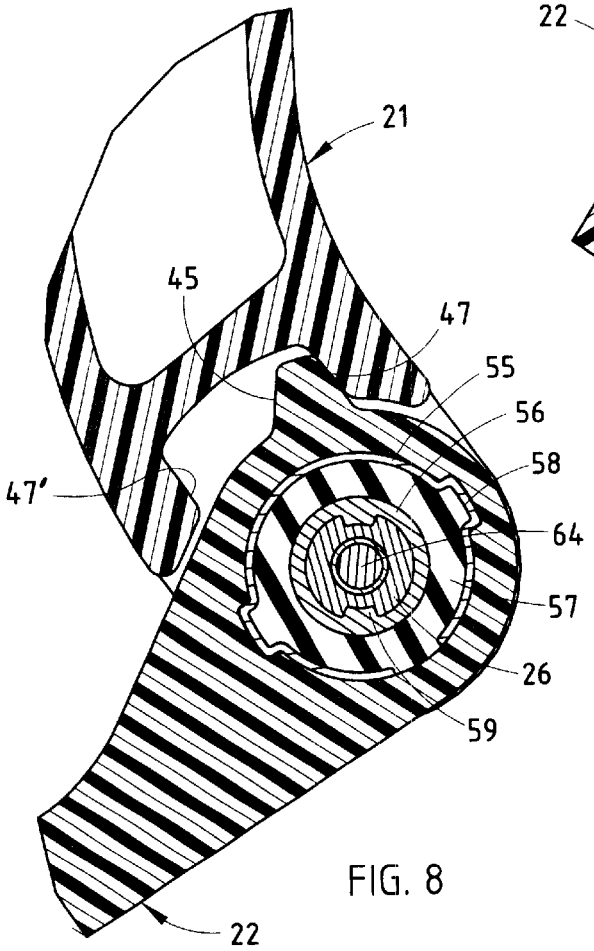
FIG. 8 is a view similar to FIG. 7 but with the joint in a rotated/reclined position where the chair back is fully reclined.

The link 22 (FIG. 2) also comprises a molded polymeric component. The link 22 is shaped like a dog-bone, and has an upper end 40 with a transverse hole 41 and a lower end 42. The hole 41 has a pair of channel-like keyways 43 that extend along the longitudinal axis 29 of the hole 41. A ridge 45 is located on an outside top surface 46 of the upper end 40, and extends parallel the keyways 43. The ridge 45 is located and shaped to engage the mating lip 47 on the lower end of body 30 to limit rotation of the link 22 relative to the body 30. When the torsion spring bushing 24 is pre-tensioned, the stop formed by features 45/47 limits rotation of the components 21 and 22 to maintain the pre-tension (see FIG. 7). A second ridge 47' is located on the components 21 to limit arcuate rotation of the components 21 and 22 in a second opposite direction (FIG. 8), such as to limit recline. The stop 45/47 holds the upright 21 in its upright or home position, and the stop 45/47' limits travel of the upright 21 in its rearmost reclined position.

Figure 10:
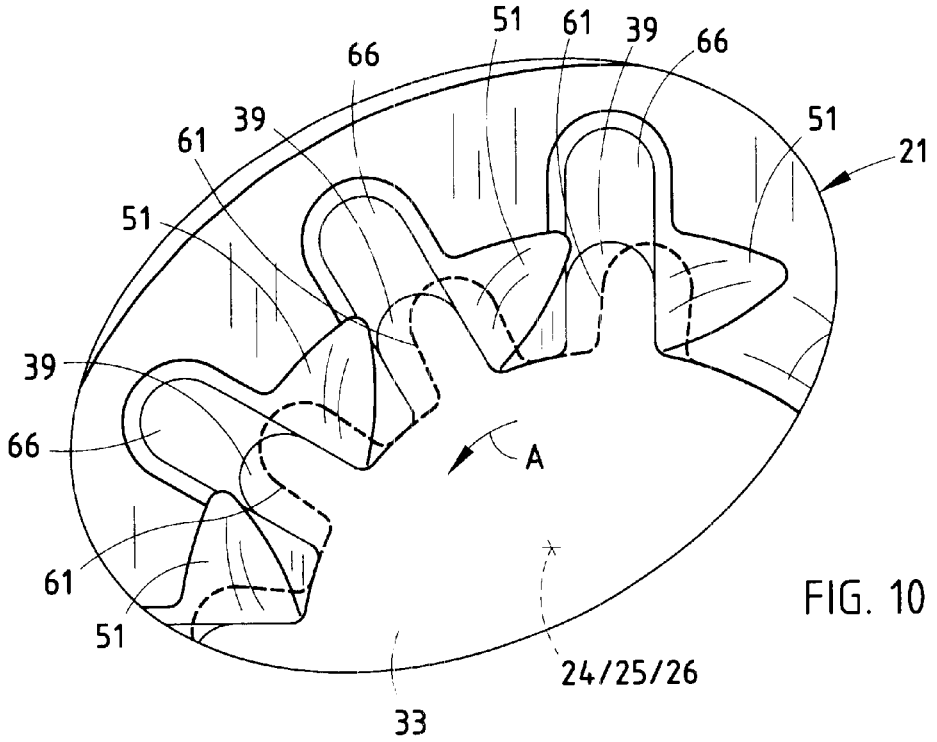
FIG. 10 is a view similar to FIG. 9, but with the anchors tightened axially to about 50% of their final depth, such that the spline fingers have engaged the angled surfaces and are rotated in direction "A" about 50% toward their final destination in the spline grooves.

Between each of the grooves 39 (FIG. 6) is an inwardly-extending radial section of material or finger 50. Each of the sections 50 includes an exterior angled surface 51 that is angled relative the axial direction 29. The angled surfaces 51 form ramps that engage mating features or spline ridges 61 (FIGS. 2 and 10) on the anchors 25 and 26 to twist (i.e. rotate) and thus pre-tension the torsion spring bushing 24 during assembly, as discussed below.

The torsion spring bushing 24 (FIG. 2) includes an outer ring member 55, an inner ring member 56, and a rubber spring member 57 bonded between the two ring members 55 and 56. The outer ring member 55 is a stamped metal component and includes oppositely-facing outwardly-extending ridge keys 58 formed to interlock with the channel keyways 43 in the upper end 40 of the link 22. The keys 58 and keyways 43 are shaped to slide linearly together for assembly in a direction parallel to the axis of rotation 29. When interconnected, they interlockingly engage to prevent undesired rotation. The inner ring member 56 is a machined component (although it could also be stamped or otherwise formed), and includes oppositely-facing inwardly-extending ridge keys 59 formed to interlock with the channel keyways 60 formed in the anchors 25 and 26, as described below.

The anchors 25 and 26 are powdered metal components. The anchors 25 and 26 each have a tubular shank 62 with the channel keyways 60 formed on an outside surface for engaging ridge keys 43 in the torsion spring bushing 24. They also each include L-shaped spline ridges 61 extending from the trailing end of the shank 62 and onto the heads 63 that mate with grooves 39. The shanks 62 of the anchors 25 (and 26) are hollow and include end surfaces that abut each other upon complete and full assembly. The washer-like heads 63 fit mateably into the recesses 37 upon complete and full assembly. The anchor 25 includes a screw 64 that threadably engages a threaded hole 65 in the other anchor 26. The screw 64 is run in during assembly, and draws the anchors 25 and 26 together, causing the spline ridges 61 to operably engage the angled surfaces 51 for pre-tensioning the spring 57.

Figure 9:
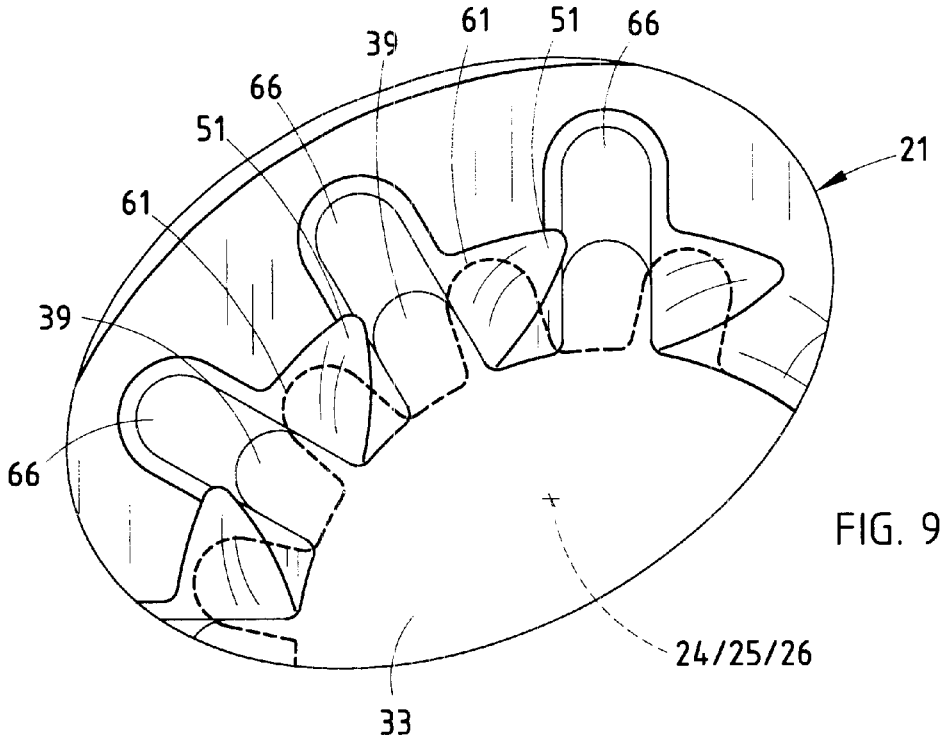
FIG. 9 is a fragmentary view of the circled area IX in FIG. 6, with the spline fingers on the anchors being added and shown in dashed lines, the spline fingers being shown as 16° off from the receiving spline grooves; the keyways and channels of the link, the spring bushing, and the back upright engaging to initially orient the anchors relative to the back upright, but the illustrated arrangement being before the anchors are axially tightened to cause the spline fingers to engage the angled surfaces to rotate and pre-tension the spring bushing.

More specifically, during assembly, as the anchors 25 and 26 are brought together along the axis direction 29 by screw 64, the ridges 61 engage the angled surfaces 51 (see FIG. 9) and then force the anchors 25 (and 26) to rotate a predetermined number of degrees about the axis 29 relative to the link 22 (see FIG. 10) where the anchors are inserted 50% of the way. When fully assembled, the L-shaped spline ridges 61 fit into mating L-shaped pockets 66 that align with the grooves 39. This rotation creates the pre-tension in the rubber spring member 57, since the outer ring member 55 is held in a stationary position by stop 45/47 and the inner ring member 56 is forced to rotate by action of the anchors 25 and 26. The amount of force to accomplish the assembly and provide the desired pre-tension in the rubber spring member 57 is affected by a number of different factors. For example, the following are some of the factors that affect the step of assembly and affect the design of components: the amount of the desired rotation for pre-tensioning the spring 57, the angle of inclination of the angled surfaces 51 along with the number and length of the angled surfaces 51, the size and physical "geometry" of the joint design (such as the maximum distance of draw or length of screw that can be used), the strength and lubricity of all components, the functional requirements of the assembly (such as the gross torsional force required by the chair design), and similar factors. The illustrated arrangement rotates the spring 57 about 16 degrees during assembly, and the angled surfaces extend arcuately at an angle of about 45° to the axis 29.

Testing has shown that the joint 20 can be made to be assembled without use of a separate fixture or clamp assist when assembling the joint 20 and pre-tensioning the spring 57. For example, in the illustrated arrangement, when the rotation of the screw 64 is in the same direction as the pre-tensioning direction for the spring 57, it has been found that the threads in the anchors 25 and 26 and the angled surfaces and related components of the illustrated arrangement will provide sufficient draw or "pulling force" and structure necessary for full and complete assembly. However, on the opposite side, where the rotation of the screw 64 is in an opposite direction of the pre-tensioning direction for the spring 57, the illustrated arrangement requires an assist to help clamp and draw the anchors 25 and 26 together and to rotate the anchors 25 and 26 for full and complete assembly.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A jointed apparatus comprising:

first and second structural members;

a torsion spring adapted to pivotally support and rotationally bias the first structural member relative to the second structural member about a joint;

an anchor for holding the first and second structural members together; and a pre-tensioning device that automatically rotates during assembly and thus torsionally tensions the torsion spring as the first and second structural members, the torsion spring and the anchor member are assembled together in a coaxial direction.

2. The jointed apparatus defined in claim 1, wherein the pre-tensioning device includes features integrally formed on one or more of the first structural member, the second structural member, the anchor, and the pre-tensioning device.

3. The jointed apparatus defined in claim 2, wherein at least one of the features is integrally formed on the anchor.

4. The jointed apparatus defined in claim 3, wherein the anchor comprises two mating pieces that telescope together in a direction parallel an axis of rotation defined by the joint.

5. The jointed apparatus defined in claim 4, wherein the at least one feature includes angled surfaces forming ramps that axially engage in a manner causing rotation of a portion of the torsion spring as the two mating pieces are assembled together.

6. The jointed apparatus defined in claim 5, including a stop on at least one of the first and second structural members, and wherein the torsion spring is pre-tensioned against the stop by action of the angled surfaces during assembly.

7. The jointed apparatus defined in claim 1, wherein the anchor comprises two mating pieces that telescope together in a direction parallel an axis of rotation defined by the joint.

8. A jointed apparatus comprising:

first and second structural members;

a torsion spring adapted to pivotally support and rotationally bias the first structural member relative to the second structural member about a joint;

an anchor for holding the first and second structural members together; and a pre-tensioning device that torsionally tensions the torsion spring as the first and second structural members, the torsion spring and the anchor member are assembled together, wherein the pre-tensioning device includes angled surfaces and mating surface on the anchor and on at least one of the structural members, the angled surfaces forming ramps that engage the mating surfaces to thus angularly rotate the torsion spring relative to the first and second structural members during coaxial assembly of the anchor to the structural members.

9. A jointed apparatus comprising:

first and second structural members;

a torsion spring adapted to pivotally support and rotationally bias the first structural member relative to the second structural member about a joint;

an anchor for holding the first and second structural members together; and a pre-tensioning device that torsionally tensions the torsion spring as the first and second structural members, the torsion spring and the anchor member are assembled together, wherein the torsion spring has an inner member keyed to the first structural member, an outer member keyed to one of the second structural member and the anchor, and an elastomeric member located between the inner and outer members.

10. The jointed apparatus defined in claim 9, wherein the elastomeric member comprises rubber.

11. The jointed apparatus defined in claim 9, wherein the outer member includes a first key engaging the anchor member, and the anchor member includes a second key engaging the second structural member.

12. The jointed apparatus defined in claim 1, wherein the first and second structural members are first and second pivotally-connected components of a seating unit.

13. The jointed apparatus defined in claim 12, wherein the seating unit includes a back having an upright frame member, and one of the first and second structural members comprises the upright frame member.

14. The jointed apparatus defined in claim 12, wherein the seating unit comprises a chair having a seat, a base, a back upright, and at least one pivot link connected to each other at multiple joints to define a four-bar linkage for supporting the back upright for movement between reclined and upright positions, one of the multiple joints being the first-mentioned joint.

15. A jointed apparatus comprising:

first and second elongated structural members pivoted together and defining a joint;

a bushing including a first section attached to the first structural member, a second section, and a torsion spring connecting the first and second sections; and a pre-tensioning device engaging the second section and the second structural member, the pre-tensioning device having angled surfaces forming ramps on at least one of the pre-tensioning device and the structural members that inter-engage mating surfaces on another of the pre-tensioning device and the structural members to automatically rotate the second section during assembly to pre-tension the torsion spring during coaxial assembly.

16. The jointed apparatus defined in claim 15, wherein the pre-tensioning device includes at least one anchor member interconnecting the first and second structural members.

17. The jointed apparatus defined in claim 16, wherein the at least one anchor member includes first and second anchor members that engage in a direction parallel an axis of rotation defined by the joint.

18. The jointed apparatus defined in claim 16, wherein the at least one anchor member includes angled surfaces that engage mating surfaces on one or more of the first structural member, the second structural member, and the bushing.

19. The jointed apparatus defined in claim 1, wherein the first and second structural members form components of a seating unit.

20. The jointed apparatus defined in claim 19, wherein at least one of the first and second structural members forms a leg of a chair.

21. The jointed apparatus defined in claim 15, wherein the first and second elongated structural members form components of a support structure for a seating unit.

* * * * *